US007125635B2

(12) United States Patent
Wu et al.

(10) Patent No.: US 7,125,635 B2
(45) Date of Patent: Oct. 24, 2006

(54) IMAGING MEMBERS

(75) Inventors: Jin Wu, Webster, NY (US); Nancy Lynn Belknap, Rochester, NY (US); Jennifer Y. Hwang, Penfield, NY (US); Liang-bih Lin, Webster, NY (US); Yuhua Tong, Webster, NY (US)

(73) Assignee: Xerox Corporation, Stamford, CT (US)

( * ) Notice: Subject to any disclaimer, the term of this patent is extended or adjusted under 35 U.S.C. 154(b) by 217 days.

(21) Appl. No.: 10/744,171

(22) Filed: Dec. 23, 2003

(65) Prior Publication Data

US 2005/0137301 A1 Jun. 23, 2005

(51) Int. Cl.
*G03G 5/14* (2006.01)

(52) U.S. Cl. ..... 430/64; 430/65

(58) Field of Classification Search ..... 430/64, 430/65

See application file for complete search history.

(56) References Cited

U.S. PATENT DOCUMENTS

| | | | | |
|---|---|---|---|---|
| 5,635,324 | A | 6/1997 | Rasmussen et al. | |
| 5,641,599 | A | 6/1997 | Markovics et al. | |
| 6,261,729 | B1 | 7/2001 | Yuh et al. | |
| 6,383,699 | B1 * | 5/2002 | Yuh et al. | 430/65 |
| 6,586,148 | B1 | 7/2003 | Graham et al. | |
| 6,645,687 | B1 | 11/2003 | Vong et al. | |

* cited by examiner

*Primary Examiner*—Mark A. Chapman
(74) *Attorney, Agent, or Firm*—Eugene O. Palazzo; Fay, Sharpe, Fagen, Minnich & McKee, LLP

(57) ABSTRACT

An undercoat composition and resulting layer formed therefrom, is disclosed which finds particular application in multilayered photoreceptors, such as are used in xerographic printing systems. The undercoat composition comprises an n-type pigment and a binary binder comprising an isocyanate and a phenolic resin.

28 Claims, 3 Drawing Sheets

IMAGING MEMBERS

BACKGROUND

There is disclosed herein, layered imaging members such as multi-layered photoreceptors utilized in electrophotography. The layered imaging members include an undercoat composition that produces enhanced hole or electron blocking layer properties. The embodiment finds particular application in conjunction with systems for printing and will be described with particular reference thereto. However, it is to be appreciated that the present exemplary embodiment is also amenable to other like applications.

An electrophotographic imaging member device comprising at least one photoconductive insulating layer is imaged by uniformly depositing an electrostatic charge on the imaging surface of the electrophotographic imaging member and then exposing the imaging member to a pattern of activating electromagnetic radiation, such as, light which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member such as paper.

A number of current electrophotographic imaging members are, for example multilayered photoreceptors that, in a negative charging system, comprise a substrate support, an optional electrically conductive layer, an optional charge or hole blocking layer, an optional adhesive layer, a charge generating layer, a charge transport layer, and optional protective or overcoating layer(s). The imaging members of multilayered photoreceptors can take several forms, for example, flexible belts, rigid drums, flexible scrolls, etc. Flexible photoreceptor belts may either be seamed or seamless belts. In a typical flexible photoreceptor belt design, an anti-curl layer may, for example, also be employed on the backside of the flexible substrate support, the side opposite to the electrically active layers, to achieve the desired photoreceptor belt flatness.

After formation of an electrically conductive surface, a charge blocking layer, hereinafter referred to as a hole blocking layer, may be applied thereto for photoreceptors. Generally, hole blocking layers for positively charged photoreceptors allow holes from the imaging surface of the photoreceptor to migrate toward the conductive layer and hole blocking layers for negatively charged photoreceptors allow electrons from the imaging surface of the photoreceptor to migrate toward the conductive layer. As a result, the hole blocking layer is an electronic barrier to holes or electrons between the adjacent photoconductive layer(s) and the underlying conductive layer. The compositions which comprise the hole blocking layer may be applied by any suitable conventional techniques to produce a dry thickness of less than about 0.2 micrometer.

Many currently available charge or hole blocking layers consist of particulates of metal oxides dispersed in polymeric binders. For example, one such composition utilizes titanium dioxide and silica dispersed in a phenolic resin. However, many of such compositions suffer from short cycle life with early CDS (charge deficient spots) printouts during cycling and/or exhibit a number of large spot printout defects.

In this regard, stable cycling is preferred for photoreceptors. Any cycling up or cycling down is undesirable. Additionally, printout defects are also undesirable. These defects are caused by the penetration of carbon fiber(s) through the multilayer array of the photoreceptor to the substrate. This produces a conductive path across the photoreceptor, thus resulting in black spot defects.

Additionally, silica is utilized in conventional compositions to suppress "plywooding". Plywooding refers to the formation of unwanted patterns in electrostatic latent images caused by multiple reflections during light exposure of a charged imaging member. When developed, these patterns resemble plywood. Silica is a micro particle that may be added to the composite to scatter light, thus minimizing the plywood-like print patters. However, the use of silica in conventional compositions is believed to contribute to early charge deficient spots during cycling.

Hence, it would be desirable to provide an undercoat composition for producing charge or hole blocking layers with longer cycle life stability. Additionally, it would be beneficial to provide an undercoat layer which inhibits carbon fiber penetration to the substrate and which minimizes large spot printing defects.

The present exemplary embodiment contemplates new and improved undercoat compositions for forming hole blocking layers, and the longer life, imaging members produced therewith, which overcome the above-referenced problems and others.

BRIEF DESCRIPTION

Disclosed herein is an imaging member, such as a photoconductive imaging member, comprised of an optional substrate, an optional electrically conductive layer, a hole blocking layer, a charge generating layer, a charge transport layer, and an optional overcoat layer, wherein the hole blocking layer is formed from a composition comprising a binary binder and an n-type pigment, wherein the binary binder comprises an isocyanate and a phenolic resin. Such a hole blocking layer results in an increase in the service life of the imaging member and enhances the hole blocking layer's cycle life. Additionally, the hole blocking layer formed from this composition minimizes carbon fiber penetration to the substrate, thereby decreasing the number of large spot printing defects.

The photoconductive imaging member may be a rigid drum design or in flexible belt configuration. For flexible imaging member belt, it can be a seamed belt or a seamless belt. Moreover, for simplicity purposes, the discussions hereinafter will be generally presented with reference to imaging members in a flexible belt configuration.

Also disclosed herein is an imaging member comprising:

a supporting substrate;

a hole blocking layer;

a charge generating layer deposited thereon; and, a charge transport layer deposited on the charge generating layer, wherein the hole blocking layer is formed from a composition comprising a binary binder and an n-type pigment. The binary binder is comprised of from about 1 weight percent to about 70 weight percent of an isocyanate and from about 30 weight percent to about 99 weight percent of a phenolic resin. Preferably, the binary binder comprises from about 5 weight percent to about 50 weight percent of an isocyanate and from about 50 weight percent to about 95 weight percent of a phenolic resin. More preferably, the binary binder comprises from about 10 weight percent to about 30 weight percent of an isocyanate and from about 70 weight percent to about 90 weight percent of a phenolic resin. Also included in the composition is from about 30 weight percent to about 80 weight percent of an n-type pigment, preferably from about 50 weight percent to about 70 weight percent, and more preferably from about 55 weight percent to about 65 weight percent.

Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

In a still further embodiment, the development relates to imaging members with an enhanced hole blocking layer. The imaging members posses a number of the advantages illustrated herein inclusive of excellent performance properties. For example, imaging members constructed utilizing the undercoat composition disclosed herein are less susceptible to develop printout defects as well as demonstrate improved cycle stability.

Also disclosed herein is a negatively charged electrophotographic imaging member comprising a supporting substrate having an optional conductive surface or layer, a hole blocking layer, an optional adhesive layer, a charge generating layer, a charge transport layer, and an optional overcoat layer, wherein the hole blocking layer comprises from about 30 weight percent to about 80 weight percent of n-type pigments and from about 20 weight percent to about 70 weight percent of a binary binder comprising an isocyanate and a phenolic resin. Preferably, the hole blocking layer comprises from about 50 weight percent to about 70 weight percent of pigments, and more preferably, from about 55 weight percent to about 65 weight percent of pigment are used for achieving optimum function. The resulting imaging member may also contain an anti-curl layer coated to the backside of the support substrate to provide flatness.

In accordance with a further aspect of the present exemplary embodiment, an undercoat composition for forming a hole blocking layer is disclosed. The composition comprises a binary binder and an n-type pigment. The binary binder includes an isocyanate and a phenolic resin. The composition produces, when cured, a hole blocking layer having an increased hardness. Such a hardness increase is in the range of about 10 percent to about 40 percent in comparison to conventional hole blocking layers at the same thicknesses. This composition has been found to significantly improve the cycle life of the resulting imaging member.

In accordance with yet another aspect of the present exemplary embodiment, the carbon fiber resistance of the hole blocking layers is enhanced though the use of undercoat compositions comprising a binary binder, consisting of a blocked isocyanate and a phenolic resin; and, an n-type pigment, such as titanium dioxide. This composition produces, when utilized to produce a hole blocking layer, an increase in hardness of the matrix of the hole blocking layer. This, in part, is because the isocyanate reacts with the phenolic resin and becomes part of the polymer network. Additionally, the isocyanate reacts with titanium dioxide, and the formation of urethane linkages can eliminate moisture-sensitive hydroxyl groups on the surface of the titanium dioxide nano particles. Furthermore, if silica is optionally included, the isocyanate reacts with the silica. This may add to cycle life improvement, since moisture-sensitive groups are eliminated and interfaces among particles and binders are strengthened.

In an additional embodiment, there is disclosed an undercoat composition for use in forming a hole blocking layer in a multi-layered photoreceptor array. The composition comprises an effective amount of an isocyanate, such as a blocked aromatic or aliphatic isocyanate, with a phenolic resin, such as formaldehyde polymers with phenols or bisphenols, to produce a binary binder system. The composition additionally includes an effective amount of an n-type pigment, such as a metal oxide component.

In another aspect, the exemplary embodiment provides a hole blocking layer for use in a multi-layered photoreceptor. The hole blocking layer is formed from a composition which fails to contain silica. The composition comprises a phenolic resin, an n-type pigment, such as a metal oxide, and an isocyanate, such as a blocked aromatic or aliphatic isocyanate. The phenolic resins include, among others, formaldehyde polymers with phenols or bisphenols.

In a further aspect of the exemplary embodiment, a method of forming a hole blocking layer is provided. The method comprises forming a dispersion of phenolic resin, a metal oxide, and an isocyanate in a liquid carrier. The method also comprises depositing a layer of the dispersion on a substrate. Additionally, the method comprises heating the deposited material to form the hole blocking layer.

One advantage of the present exemplary embodiment is that the cycle life of an imaging member produced utilizing the undercoat composition can be improved.

A further advantage of the exemplary embodiment is that problems associated with charge deficient spots and large spot printing defects can be remedied.

Another advantage of the present exemplary embodiment is that the electrical characteristics of the undercoat composition, when utilized to produce a hole blocking layer, can be enhanced.

Yet another advantage of the present exemplary embodiment is that the carbon fiber resistance of an undercoat composition, and the resulting hole blocking layer produced thereby, can be improved.

Still further advantages and benefits of the present exemplary embodiments will become apparent to those of ordinary skill in the art upon reading and understanding the following detailed description of the preferred embodiments.

BRIEF DESCRIPTION OF THE DRAWINGS

The exemplary embodiment may take form in various components and arrangements of components, and in various steps and arrangements of steps. The drawings are only for purposes of illustrating preferred embodiments and are not to be construed as limiting the exemplary embodiment.

Figure 1:
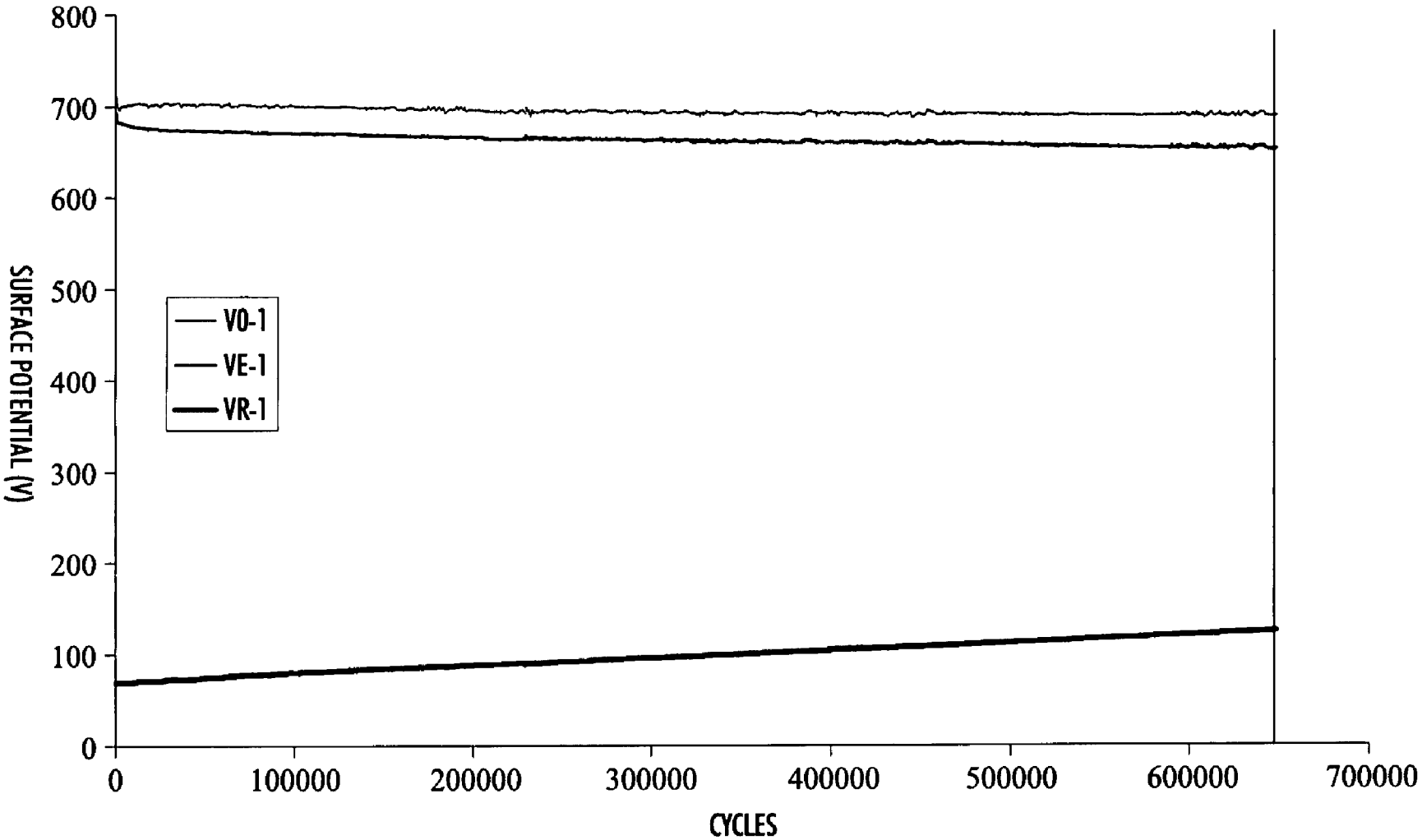
FIG. 1 is a graph of surface potential versus cycles for an exemplary embodiment hole blocking layer.

Still further advantages and benefits of the present exemplary embodiments will become apparent to those of ordinary skill in the art upon reading and understanding the following detailed description of the preferred embodiments.

DETAILED DESCRIPTION

The present exemplary embodiment provides an imaging member having a hole blocking layer formed from an undercoat composition. The undercoat composition comprises an effective amount of one or more n-type pigments and an effective amount of a binary binder comprising a phenolic resin and an isocyanate. Details of various multilayered photoreceptors and undercoat compositions are provided in various issued patents, such as but not limited to U.S. Pat. Nos. 5,635,324; 5,641,599; 6,261,729; 6,645,687; and 6,586,148, all of which are hereby incorporated in their entirety by reference.

The n-type pigments include metal oxides such as titanium dioxide, tin oxide, aluminum oxide, zinc oxide, or combinations of these agents. Preferably, the metal oxide is titanium dioxide. The total amount of pigment(s) used in the composition ranges from about 30 weight percent to about 80 weight percent, from about 50 weight percent to about 70 weight percent, and from about 55 weight percent to about 65 weight percent. The exemplary embodiment includes compositions containing greater than or less than these amounts.

The binary binder includes a phenolic resin which may be any suitable phenolic resin component typically utilized in undercoat compositions. Examples of such phenolic resins include formaldehyde polymers with phenol, p-tert-butylphenol an cresol such as Varcum 29159 and 29101 (OxyChem Co.), and Durite 97 (Borden Chemical), or formaldehyde polymers with ammonia, cresol and phenol such as Varcum 29112 (OxyChem Co.), or formaldehyde polymers with 4,4'-(1-methylethylidene) bisphenol such as Varcum 29108 and 29116 (OxyChem Co.), or formaldehyde polymers with cresol and phenol such as Varcum 29457 (OxyChem Co.), Durite SD-423A, SD-422A (Borden Chemical), or formaldehyde polymers with phenol and p-tert-butylphenol such as Durite ESD 556C (Borden Chemical), among others.

The binary binders also include an isocyanate. The details of the isocyanate, such as an aromatic block isocyanate, are described later herein. However, most known types of isocyanate are believed to be suitable for use in the various embodiments disclosed herein.

In this regard, a wide array of isocyanates may be utilized in the exemplary embodiment compositions. Examples of such isocyanates include toluene diisocyanate (TDI) and diphenylmethane 4,4'diisocyanate (MDI). MDI is also known as methylene bisphenyl isocyanate. Toluene diisocyanate (TDI), $CH_3(C_6H_3)(NCO)_2$, has two common isomers, the 2,4 & the 2,6 diisocyanate. The pure (100%) 2,4 isomer is available and is used commercially, but most TDI is sold as 80/20 or 65/35 2,4/2,6 blends.

Diphenylmethane 4,4' diisocyanate (MDI) is $NCO(C_6H_4)CH_2(C_6H_4)NCO$. The pure product has a functionality of 2, but it is common to blend pure material with mixtures of higher functionality MDI oligomers (often known as crude MDI) to create a range of functionalities/crosslinking potential.

As previously noted, the exemplary embodiment composition utilizes a blocked aromatic isocyanate. Typical blocking agents used include malonates, triazoles, ϵ-caprolactam, sulfites, phenols, ketoximes, pyrazoles, alcohols, and combinations thereof.

Suitable examples include, aromatic isocyanates such as Alcure 4450 from Eastman Chemical, aliphatic isocyanates such as Sumidole 3175, manufactured by Sumitomo Bayer Urethant Co., Ltd. Others include Alcure 4470 from Eastman Chemical, a polymeric aliphatic isocyanate blocked with triazole; Alcure 4430 from Eastman Chemical, another polymeric aliphatic isocyanate; Alcure 4431 from Eastman Chemical.

It has been found that the addition of the isocyanate to the phenolic resin to produce a binary binder system, substantially increases the hardness of the resulting undercoat or hole blocking layer. In this regard, a comparison of the hardnesses produced by a conventional undercoat composition failing to contain an isocyanate (i.e., $TiO_2$/phenolic resin in a ratio of 60/40) produced a hardness of 0.95 GPa and an undercoat containing an isocyanate (i.e., $TiO_2$/phenolic resin/isocyanate in a ratio of 60/35/5) produce an increased hardness of 1.32 GPa. This represented a 1.38 fold increase over the conventional composition. Other binary binder blends utilized in the compositions disclosed herein have produced increases of from about 0.95 GPa to about 1.05 GPa. This data was collected utilizing a nano indentation technique which is briefly described as follows: Sixteen indentations, 10 μm apart were placed in the surface of each sample at a loading rate of 20 μN/sec. The initial load was 400 μN and decreased by 30 μN/indent. The indentation depth varied from 60 nm to 100 nm from the surface. The reduced modulus $E_{red.}$ was calculated via equation (1) using the Oliver-Pharr method by determining the contact area $A_C$ from the area function of the Berkovich tip, equation (2) and calculating the unloading slope dP/dh. E is the elastic modulus of the sample and ν is the Poisson's ratio. The tip area function $A_C$ of the Berkovich tip was determined from indentation on Aluminum.

$$E_{red.} = \frac{E}{1-\nu^2} = \frac{\sqrt{\pi}}{2}\frac{dP}{dh}\frac{1}{\sqrt{A_C}} \tag{1}$$

$$A_C = 24.5h_C^2 + 4.4518e2h_C \tag{2}$$

Hardness H, is simply determined from the maximum load divided by the contact area, $H=P_{max}/A_C$.

In the binary binder, the phenolic resin/isocyanate weight ratios vary from about 99/1 to about 30/70, preferably from about 95/5 to about 50/50, and most preferably from about 90/10 to about 70/30. Consequently, the binary binder comprises from about 30 weight percent to about 99 weight percent, preferably from about 50 weight percent to about 95 weight percent, and most preferably 70 weight percent to about 90 weight percent of a phenolic resin and from about 1 weight percent to about 70 weight percent, more preferably, about 5 weight percent to about 20 weight percent and most preferably 10 weight percent to about 30 weight percent of isocyanate resin.

Upon forming an exemplary embodiment undercoat or hole blocking layer from the exemplary embodiment undercoat composition, the resulting layer typically has a thickness of about 0.001 to about 50 microns, particularly about 0.01 to 30 microns, and more particularly from about 1 micron to about 20 microns.

Optionally, the undercoat or hole blocking layer may contain suitable amounts of additives, for example from about 1 weight percent to about 10 weight percent, of conductive or nonconductive particles, such as silicon nitride, carbon black, and the like, to enhance, for example, electrical and optical properties.

Furthermore, silica can also be optionally added to the composition. However, it has been found that silica and other plywood suppressants could cause early charge deficient spots printouts with cycling. Hence, complete elimination of silica is desired in certain undercoat compositions disclosed herein for both improved cycle life and carbon fiber resistance. These characteristics are produced as a result of the significantly harder layers of the new undercoat compositions generated without silica. Fully functional devices have been prepared on rough lathed substrates for plywood suppression with titanium dioxide/phenolic resin/isocyanate undercoat composition layers for longer cycle life.

In accordance with the present exemplary embodiment, an isocyanate, such as a blocked isocyanate is added to a phenolic binder to form a binary binder system. It has been discovered that addition of isocyanate to a phenolic resin significantly improves the cycle life and other electrical characteristics of the resulting undercoat layer. Additionally, the carbon fiber resistance of the disclosed undercoat composition is improved as compared to the resistance of a number of currently known undercoat compositions based on titanium dioxide dispersed in a phenolic binder. This is believed to result, in part, from a greater hardness matrix achieved with addition of isocyanate into phenolic resin.

The hole blocking layer is formed by dispersing the phenolic resin, the isocyanate, and the n-type pigment, such as a metal oxide, in a solvent to form a coating solution, coating the substrate with the coating solution, and drying it. Typical solvents include, for example, tetrahydrofuran, xylene, 1-butanol, methyl ethyl ketone (MEK), dichloromethane, and the like, and mixtures thereof. The solvent is selected for improving dispersion in the solvent and for preventing the undercoat solution from gelation with the elapse of time. The solvent may also be used for preventing the composition of the coating solution from changing as time passes, whereby storage stability of the coating solution can be improved and the coating solution can be reproduced.

Electrostatographic flexible belt imaging members having a hole blocking layer formed from the undercoat composition may be prepared by various techniques. A typical flexible supporting substrate is provided with an electrically conductive surface. For electrophotographic imaging members, at least one photoconductive layer is then applied to the electrically conductive surface. A hole or electron blocking layer is produced utilizing the undercoat composition disclosed herein. The undercoat composition is applied to the electrically conductive surface prior to the application of the photoconductive layer. If desired, an adhesive layer may be utilized between the hole or electron blocking layer and the photoconductive layer. For multilayered photoreceptors, a charge generation layer is usually applied onto the hole or electron blocking layer and a charge transport layer is subsequently coated over the charge generation layer. For ionographic imaging members, an electrically insulating dielectric layer is applied directly onto the electrically conductive surface.

The supporting substrate may be opaque or substantially transparent and may comprise numerous materials having the required mechanical properties. Accordingly, the substrate may comprise a layer of an electrically non-conductive or conductive material such as an inorganic or an organic composition. As electrically non-conducting materials there may be employed various thermoplastic resins known for this purpose including polyesters, polycarbonates, polyamides, polyurethanes, and the like which are flexible in thin webs. The electrically insulating or conductive substrate should be flexible and in the form of an endless flexible belt. Preferably, the endless flexible belt shaped substrate comprises a commercially available biaxially oriented polyester.

The thickness of the supporting substrate layer depends on numerous factors, including beam strength, mechanical toughness, and economical considerations. Thus, the substrate layer used for a flexible belt application may be of substantial thickness, for example, about 150 micrometers, or of a minimum thickness of about 50 micrometers, provided that it produces no adverse effects on the belt. Preferably, the thickness of the substrate layer is between about 75 micrometers and about 100 micrometers for optimum flexibility, beam rigidity, and minimum stretch during cycling.

Where a separate flexible conductive layer is employed, it may vary in thickness over substantially wide ranges depending on the optical transparency and degree of flexibility desired for the electrostatographic member. Accordingly, for a flexible electrophotographic imaging device, the thickness of the conductive layer may be between about 20 angstroms and about 750 angstroms, and more preferably between about 100 angstroms and about 200 angstroms for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, copper, gold, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contain a thin metal oxide layer that has formed on the outer surface of an oxidizable metal layer. A typical electrical conductivity for conductive layers for electrophotographic imaging members in slow speed copiers is about $10^{-2}$ to $10^{-3}$ per ohms/square.

After formation of an electrically conductive surface, a hole blocking or electron blocking layer, is applied thereto for photoreceptors. The hole blocking layer is produced utilizing the undercoat composition disclosed herein. The undercoat composition is applied by any suitable conventional technique such as spraying, dip coating, draw bar coating, gravure coating, silk screening, air knife coating, reverse roll coating, vacuum deposition, chemical treatment and the like. The resulting hole blocking layer should be continuous and have a dry thickness of less than about 0.2 micrometer.

An adhesive layer is usually applied to the hole or charge blocking layer. Any suitable adhesive layer well known in the art may be utilized. Typical adhesive layer materials include, for example, polyesters, polyurethanes, and the like. Satisfactory results may be achieved with the adhesive layer thickness between about 0.05 micrometer and about 0.3 micrometer. Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable charge generating (photogenerating) layer may be applied onto the adhesive layer. Charge generating layers are well know in the art and can comprise homogeneous layers or photoconductive particles dispersed in a film forming binder. Examples of charge generating layers are described, for example, in U.S. Pat. Nos. 3,357,989, 3,442,781, and 4,415,639, the disclosures thereof being incorporated herein in their entirety. Other suitable photogenerating materials known in the art may also be utilized, if desired.

Any suitable polymeric film forming binder material may be employed as the matrix in of the photogenerating layer. Typical polymeric film forming materials include those described, for example, in U.S. Pat. No. 3,121,006, the disclosure thereof being incorporated herein in its entirety. The photogenerating composition or pigment may be present in the film forming binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition.

The photogenerating layer generally ranges in thickness from about 0.1 micrometer to about 5 micrometers, and more preferably from about 0.3 micrometer to about 3 micrometers. The photogenerating layer thickness is related to binder content. Higher binder content compositions generally require thicker layers for photogeneration.

Any suitable and conventional technique may be utilized to mix and thereafter apply the photogenerating layer coating mixture to the previously dried adhesive layer. Drying of the deposited coating may be effected by any suitable conventional technique.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer should exhibit negligible, if any, discharge when exposed to a wavelength of light useful in xerography, e.g. 4000 Angstroms to 9000 Angstroms. The charge transport layer is normally transparent in a wavelength region in which the electrophotographic imaging member is to be used when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. Charge transport layer materials are well known in the art.

The charge transport layer may comprise activating compounds or charge transport molecules dispersed in normally electrically inactive film forming polymeric materials. These charge transport molecules may be added to polymeric materials which are incapable of supporting the injection of photogenerated holes and incapable of allowing the transport of these holes. An especially preferred charge transport layer employed in multilayer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)phenylmethane; 4'-4"-bis(diethylamino)-2',2"-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3"-methylphenyl)-(1,1'biphenyl)-4,4'diamine; and the like, dispersed in an inactive resin binder.

Any suitable inactive thermoplastic resin binder may be employed. Typical inactive resin binders include polycarbonate resins, polyvinylcarbazole, polyester, polyarylate, polyacrylate, polyether, polysulfone, and the like. Molecular weights can vary from about 20,000 to about 150,000.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional ground strip may be utilized along one edge of the electrophotographic imaging member. The ground strip may comprise a film forming polymer binder and electrically conductive particles. The ground strip may comprise materials such as those enumerated in U.S. Pat. No. 4,664,995. The ground strip layer may have a thickness from about 7 micrometers to about 42 micrometers, and preferably from about 14 micrometers to about 23 micrometers.

An optional conventional anti-curl layer may also be employed. The anti-curl layer may comprise thermoplastic organic polymers or inorganic polymers that are electrically insulating or slightly semi-conductive. The anti-curl layer provides flatness and/or abrasion resistance and may also contain microcrystalline silica or organic particulates to improve its frictional and wear properties. The anti-curl layer is formed at the backside of the substrate, opposite to the imaging layers. The thickness of the anti-curl layer is from about 3 micrometers to about 35 micrometers. An example of an anti-curl backing layer is described in U.S. Pat. No. 4,654,284, the entire disclosure of this patent being incorporated herein by reference.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers.

For electrographic imaging members, a flexible dielectric layer overlying the conductive layer may be substituted for the photoconductive layers. Any suitable, conventional, flexible, electrically insulating dielectric thermoplastic polymer may be used in the dielectric layer of the electrographic imaging member. If desired, the concept of the morphologically improved seam configuration of this invention may be extended to flexible belts having different material compositions where cycling durability is important.

The above processes, compositions and materials can be utilized to produce a hole blocking layer having enhanced stable cycle life and an imaging member containing the same. The hole blocking layer is also resistant to carbon fiber penetration resulting in a decrease in large spot producing defects.

Various embodiments of this disclosure will further be illustrated in the following non-limiting examples, it being understood that these examples are intended to be illustrative only and that the development is not intended to be limited to the materials, conditions, process parameters and the like recited herein. All proportions are by weight unless otherwise indicated.

EXAMPLES

The preparation of the undercoat composition disclosed herein involves several modifications from conventional undercoat composition production processes. Production of the previously noted undercoat composition comprising titanium dioxide ($TiO_2$ STR-60N, Sakai Chemical) and silica ($SiO_2$ P-100, Esprit) dispersed in a phenolic resin (Varcum 29159, OxyChem) involves preparing a stock dispersion of those components in a mixture of xylene and 1-butanol. Generally, the dispersion is formed to a solids content of about 50 weight percent. The xylene and 1-butanol are generally at a 1:1 ratio. The resulting dispersion is then diluted with additional amounts of xylene and 1-butanol, at a ratio of 1:1, to form a final coating dispersion.

In accordance with the present exemplary embodiments, the stock dispersion is diluted with methyl ethyl ketone (MEK) and a solid polymeric aromatic block isocyanate, such as Alcure 4450 from Eastman Chemical, is subsequently added. One particular example of the new undercoat composition coating dispersion is comprised of about 52 parts (all parts noted herein are parts by weight) titanium dioxide, about 10 parts silica, about 38 parts phenolic resin, and about 10 parts Alcure 4450 dispersed in a trisolvent mixture of about 30 parts xylene, about 30 parts 1-butanol, and about 40 parts MEK. The cure conditions for the new undercoat composition are the same as those for the previously noted undercoat composition, i.e. 160° C. for 15 minutes. There is no pot life limitation for the new undercoat composition, since Alcure 4450 is a block isocyanate, and it only can be activated at 160° C. or higher to expose its reactive isocyanate functional groups.

Table 1, set forth below, provides ingredient information regarding Alcure 4450. Alcure 4450 from Eastman Chemical is a polymeric, aromatic, isocyanate curative based on toluene diisocyanate and blocked with ϵ-caprolactam.

TABLE 1

| Weight % | Component | CAS Registry No. |
|---|---|---|
| 90–100% | blocked isocyanate | proprietary |
| <10% | polymer caprolactam | 105-60-2 |

Table 2, set forth below, provides information as to certain physical properties of Alcure 4450.

TABLE 2

ALCURE 4450 Polymeric Isocyanate Curative

| Property[a] | Typical Value, Units[c] |
|---|---|
| Exterior Grade | No |
| NCO Equivalent Weight | 275 |
| Glass Transition Temperature ($T_g$)[d] | 64° C. |
| Baking Schedule[e] 20 min @ 160° C. | Polymeric aromatic isocyanate for low-temperature cure; Considerable savings over aliphatic curatives; Not recommended for long-term UV exposure |

[a]Unless noted otherwise, all tests are run at 23° C. (73° F.) and 50% relative humidity.
[c]Units are in SI or US customary units.
[d]approximate
[e]Baking schedule of polymeric-blocked isocyanate curative or uretdione depends on the hydroxyl-terminated polyester used.

A series of testing trials were performed to compare the undercoat layer compositions of the present exemplary embodiment to several conventional undercoat compositions. In a first trial, cycle life of the new undercoat composition was evaluated. Specifically, the cycle life in A zone (80% humidity and 28° C.) was tested with an LC scanner (a long cycling scanner) and was significantly improved as compared to the current undercoat or hole blocking layer composition comprising titanium dioxide and silica dispersed in a phenolic resin. As shown in FIG. 1, the device with a 5.4 micron thick layer of the new undercoat composition ($TiO_2$ STR-60N/silica P-100/Varcum 29159/Alcure 4450=52/10/38/10), a chlorogallium phthacyanine charge generating layer and a charge transport layer exhibits very flat cycling, and sparse charge deficient spots appears at 640 kcycles. In this regard, the chlorogallium phthacyanine charge generating layer consists of chlorogallium phthacyanine pigment dispersed in terpolymer of vinyl chloride, vinyl acetate and maleic acid (VMCH from Dow Chemical). The pigment/binder weight ratio is about 60/40. The charge transport layer consists of N,N'-diphenyl-N,N-bis(3-methyl phenyl)-1,1'-biphenyl-4,4'-diamine (40 parts) and a polycarbonate, PCZ-400 [poly(4,4'-dihydroxy-diphenyl-1-1-cyclohexane), $M_w$=40,000] (60 parts) available from Mitsubishi Gas Chemical Company, Ltd.

Figure 2:
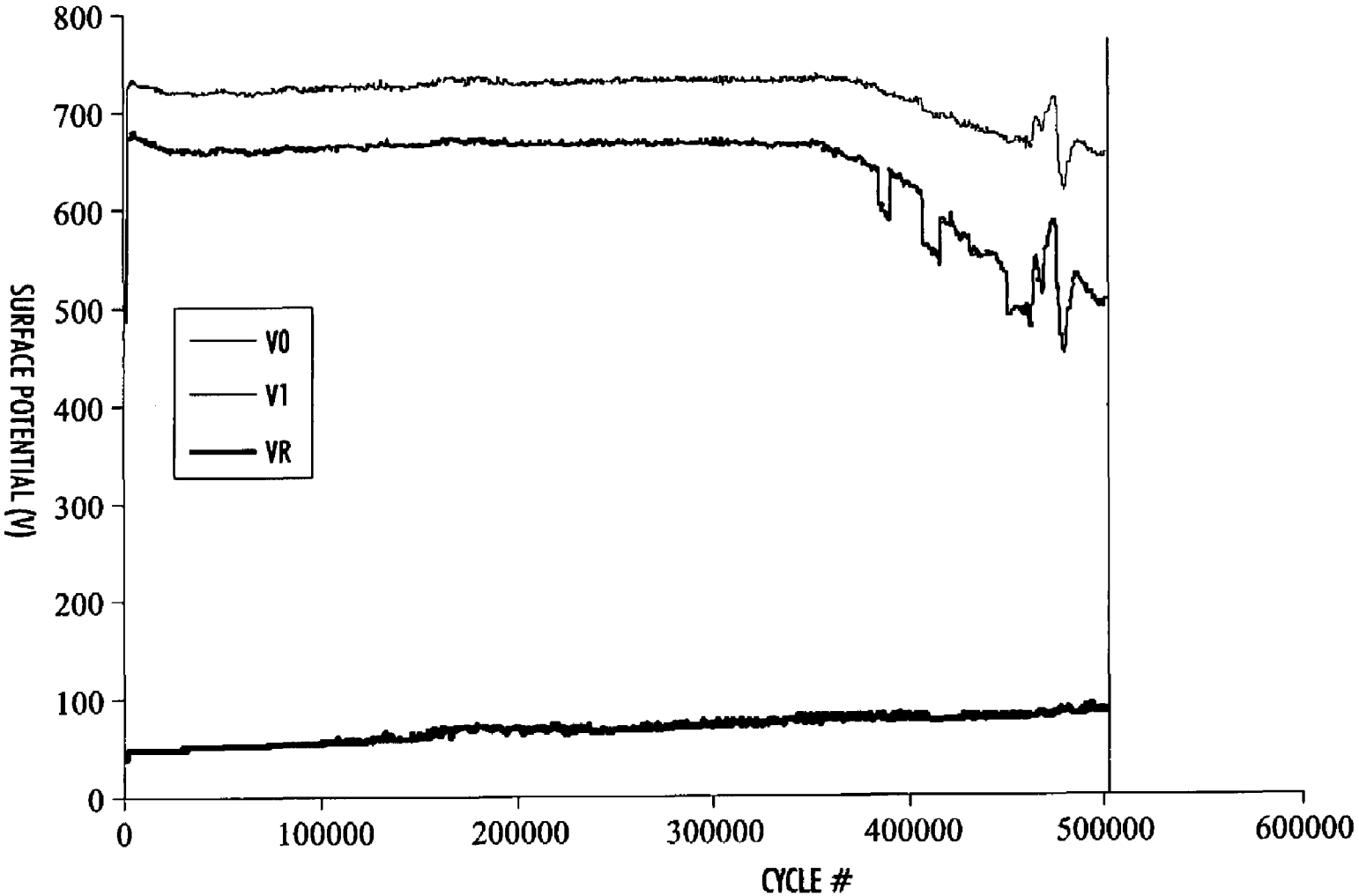
FIG. 2 is a graph of surface potential versus cycles for a conventional hole blocking layer.

In comparison, in FIG. 2, the device with a 3.8 micron thick layer of a conventional undercoat ($TiO_2$/silica/Varcum 29159=52/10/38), same as above charge generating layer and charge transport layer exhibits much shorter cyclic life, with major bending of the cyclic curves at around 370 kcycles. Very dense charge deficient spots are observed at around 500 kcycles. Similar cyclic improvements are also observed for a hydroxygallium phthalocyanine charge generating system.

Figure 3:
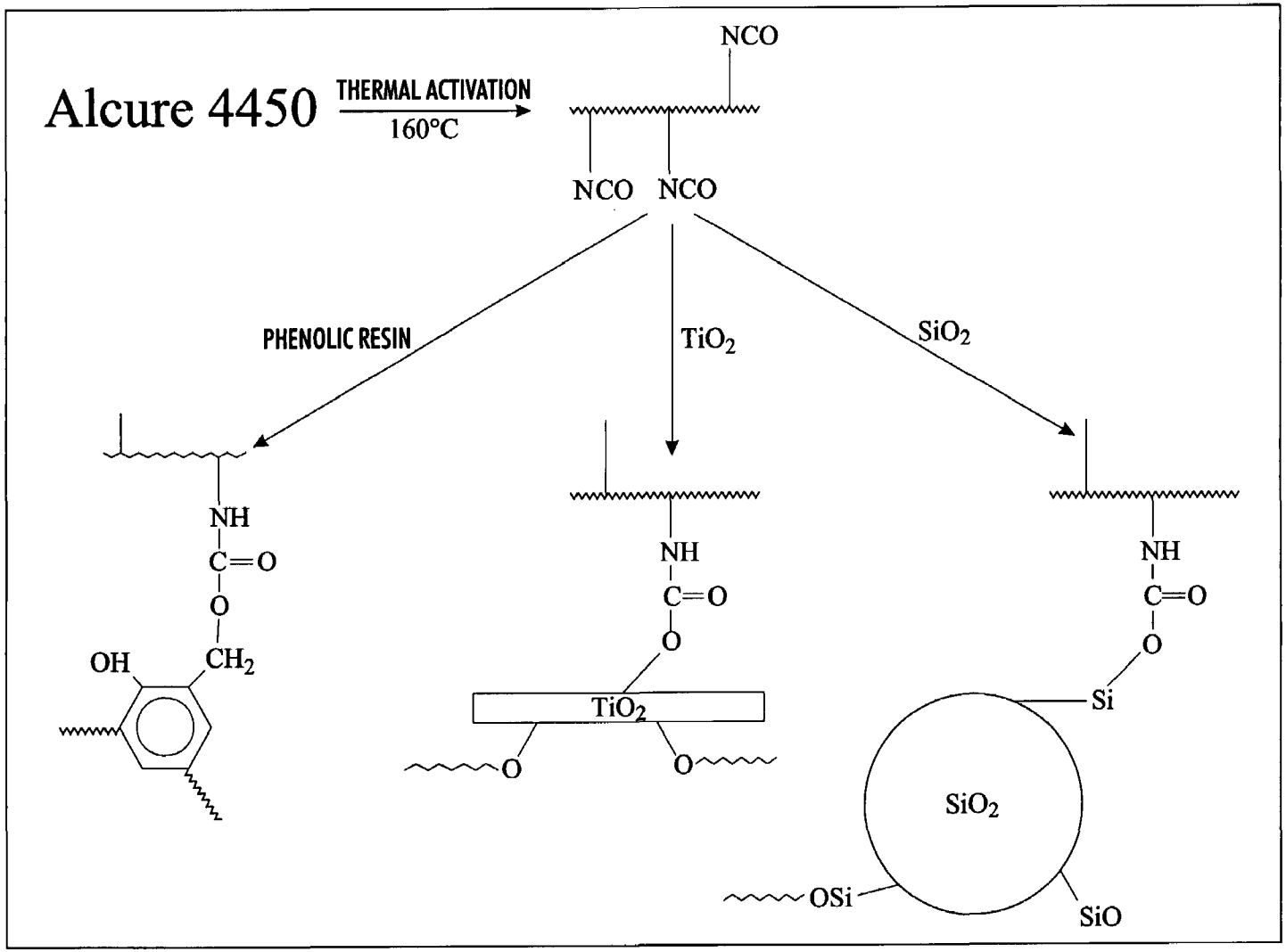
FIG. 3 is a process scheme for heating the exemplary embodiment undercoat composition.

The improvement in cycle life of the new undercoat layer composition is further explained with reference to FIG. 3. With addition of isocyanate into phenolic resin, it can react with all of the components in the undercoat composition. First, the isocyanate reacts with phenolic resin and becomes part of the polymeric network, which is believed to harden the matrix. Second, the isocyanate reacts with titanium dioxide, and the formation of urethane linkages can eliminate moisture-sensitive hydroxyl groups on the surface of the titanium dioxide nanoparticles. Finally, the isocyanate reacts with silica, which may be optionally present. This may be significant to cycle life improvement, since moisture-sensitive groups are eliminated and interfaces among particles and binders are strengthened.

In accordance with the present exemplary embodiment, the addition of isocyanate to current phenolic binder improves undercoat layer cycle life and other electrical characteristics. The carbon fiber resistance is also improved as compared to the current titanium dioxide based undercoat layers at the same thickness since a harder matrix can be achieved.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising:

an optional supporting substrate, an optional electrically conductive layer;

a hole blocking layer;

a charge generating layer;

a charge transport layer; and an optional overcoat layer, wherein the hole blocking layer is formed from a composition comprising a binary binder and an n-type pigment, and wherein the binary binder comprises a blocked isocyanate and a phenolic resin.

2. The imaging member of claim 1, wherein said n-type pigment is a metal oxide is selected from the group consisting of titanium dioxide, tin oxide, zinc oxide, and combinations thereof.

3. The imaging member of claim 2, wherein said metal oxide is titanium dioxide.

4. The imaging member of claim 1, wherein said blocked isocyanate is blocked with a blocking agent selected from the group consisting of malonates, triazoles, ϵ-caprolactum, sulfites, phenols, ketoximes, pyrazoles, alcohols, and combinations thereof.

5. The imaging member of claim 4, wherein said blocking agent is ϵ-caprolactum.

6. The imaging member of claim 1, wherein said binary binder comprises from about 30 weight percent to about 99 weight percent of the phenolic resin, and from about 1 weight percent to about 70 weight percent of the isocyanate.

7. The imaging member of claim 1, wherein said binary binder comprises from about 50 weight percent to about 95 weight percent of the phenolic resin, and from about 5 weight percent to about 50 weight percent of the isocyanate.

8. The imaging member of claim 1, wherein said binary binder comprises from about 70 weight percent to about 90 weight percent of the phenolic resin, and from about 10 weight percent to about 30 weight percent of the isocyanate.

9. The imaging member of claim 1, wherein the composition comprises from about 30 weight percent to about 80 weight percent of an n-type pigment.

10. The imaging member of claim 1, wherein the composition comprises from about 50 weight percent to about 70 weight percent of an n-type pigment.

11. The imaging member of claim 1, wherein the composition comprises from about 60 weight percent to about 65 weight percent of an n-type pigment.

12. A hole blocking layer for use in a multilayered photoreceptor, wherein said layer is formed from a composition free of silica, and wherein the composition comprises a phenolic resin, a metal oxide, and a blocked isocyanate.

13. The layer of claim 12, wherein said metal oxide is selected from the group consisting of titanium dioxide, tin oxide, aluminum oxide, zinc oxide, and combinations thereof.

14. The layer of claim 12, wherein said metal oxide is titanium dioxide.

15. The layer of claim 12, wherein said blocked isocyanate is blocked with a blocking agent selected from the group consisting of malonates, triazoles, ϵ-caprolactum, sulfites, phenols, ketoximes, pyrazoles, alcohols, and combinations thereof.

16. The layer of claim 15, wherein said blocking agent is ϵ-caprolactum.

17. The layer of claim 12, wherein said layer has a thickness of from about 0.01 microns to about 30 microns.

18. A hole blocking layer for use in a multilayered photoreceptor, wherein said layer is formed from a composition comprising a metal oxide, and a binary binder comprising a phenolic resin and a blocked isocyanate.

19. The layer of claim 18, wherein said metal oxide is selected from the group consisting of titanium dioxide, tin oxide, aluminum oxide, zinc oxide, and combinations thereof.

20. The layer of claim 18, wherein said metal oxide is titanium dioxide.

21. The layer of claim 18, wherein said blocked isocyanate is blocked with a blocking agent selected from the group consisting of malonates, triazoles, ϵ-caprolactum, sulfites, phenols, ketoximes, pyrazoles, alcohols, and combinations thereof.

22. The layer of claim 21, wherein said blocking agent is ϵ-caprolactum.

23. The layer of claim 18, wherein said layer has a thickness of from about 0.01 microns to about 30 microns.

24. The layer of claim 18, wherein said thickness is from about 1 micron to about 20 microns.

25. A method of forming a hole blocking layer, said method comprising:

forming a dispersion of a phenolic resin, a metal oxide, and a blocked isocyanate in a liquid carrier;

depositing a layer of said dispersion on a substrate;

heating said layer to form said undercoat layer.

26. The method of claim 25, wherein said heating is performed at a temperature of from about 120° C. to about 190° C.

27. The method of claim 26, wherein said heating is performed at a temperature of from about 145° C. to about 160° C.

28. The layer of claim 27, wherein said thickness is from about 1 micron to about 20 microns.

* * * * *